US007958968B1

(12) United States Patent
Stabler

(10) Patent No.: US 7,958,968 B1
(45) Date of Patent: Jun. 14, 2011

(54) TREE STAND BLIND SYSTEM

(76) Inventor: David B. Stabler, Woodbine, MD (US)

( * ) Notice: Subject to any disclaimer, the term of this patent is extended or adjusted under 35 U.S.C. 154(b) by 873 days.

(21) Appl. No.: 11/624,900

(22) Filed: Jan. 19, 2007

(51) Int. Cl.
*E04H 15/04* (2006.01)

(52) U.S. Cl. ..... 182/187; 135/90; 135/901

(58) Field of Classification Search ..... 182/187; 135/90, 96, 117, 901; 248/243, 245, 125.3
See application file for complete search history.

(56) References Cited

U.S. PATENT DOCUMENTS

| | | | | |
|---|---|---|---|---|
| 3,358,789 | A * | 12/1967 | Laun | 182/113 |
| 3,902,264 | A | 9/1975 | Radig | |
| 4,069,891 | A * | 1/1978 | McClung | 182/187 |
| 4,284,095 | A | 8/1981 | Norton | |
| 4,458,707 | A | 7/1984 | Lindaman | |
| 4,505,286 | A | 3/1985 | Madion | |
| 4,805,655 | A | 2/1989 | Justice | |
| 4,951,696 | A * | 8/1990 | Jones, Sr. | 135/90 |
| 5,214,872 | A | 6/1993 | Buyalos, Jr. | |
| D343,689 | S | 1/1994 | Green | |
| 5,669,403 | A * | 9/1997 | Belcher et al. | 135/90 |
| 7,182,091 | B2 * | 2/2007 | Maddox | 135/90 |
| 7,219,680 | B1 * | 5/2007 | Gresock | 135/90 |
| 2007/0017744 | A1 * | 1/2007 | Jacks | 182/187 |

* cited by examiner

*Primary Examiner* — Katherine W Mitchell
*Assistant Examiner* — Daniel Cahn

(57) ABSTRACT

A tree stand blind system for concealing a hunter on a tree stand and protecting the hunter from rain includes a pair of mounting brackets is secured to a tree adjacent a tree stand. Each of the mounting brackets has one of a pair of arms mounted thereto. A vertical orientation of each of the arms is adjustable with respect to the associated one of the mounting brackets. Each of the arms is positioned horizontally and extending outwardly from the tree. A suspension rod is insertable into each of the arms. A pair of blind curtains is suspended from the suspension rod. The blind curtains hang down from the suspension in a semi-circle around the tree stand to conceal the hunter on the tree stand.

15 Claims, 10 Drawing Sheets

TREE STAND BLIND SYSTEM

BACKGROUND OF THE INVENTION

1. Field of the Invention

The present invention relates to hunting blinds and more particularly pertains to a new hunting blind for concealing a hunter on a tree stand and protecting the hunter from rain.

2. Description of the Prior Art

The use of hunting blinds is known in the prior art. While these devices fulfill their respective, particular objectives and requirements, the need remains for a system that certain improved features that allow the system to be quickly secured to a tree adjacent a tree stand to conceal a hunter on the tree stand. Additionally, the system should include a canopy assembly to be positioned over the head of the hunter to inhibit rain falling on the hunter.

SUMMARY OF THE INVENTION

The present invention meets the needs presented above by generally comprising a pair of mounting brackets is secured to a tree adjacent a tree stand. Each of the mounting brackets has one of a pair of arms mounted thereto. A vertical orientation of each of the arms is adjustable with respect to the associated one of the mounting brackets. Each of the arms is positioned horizontally and extending outwardly from the tree. A suspension rod is insertable into each of the arms. A pair of blind curtains is suspended from the suspension rod. The blind curtains hang down from the suspension in a semi-circle around the tree stand to conceal the hunter on the tree stand.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
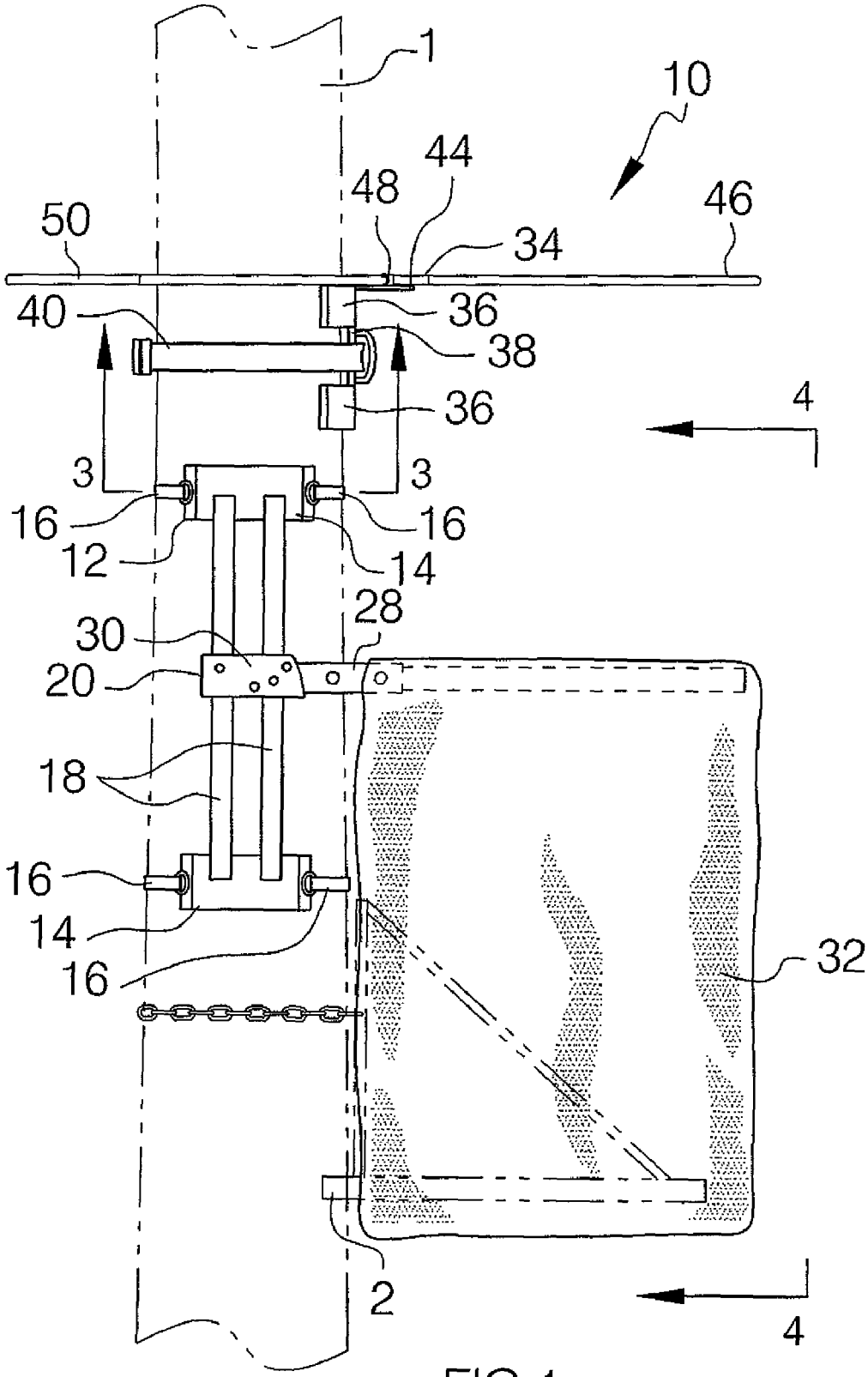
FIG. 1 is a side view of a tree stand blind system according to the present invention on a tree adjacent a tree stand.
Figure 2:
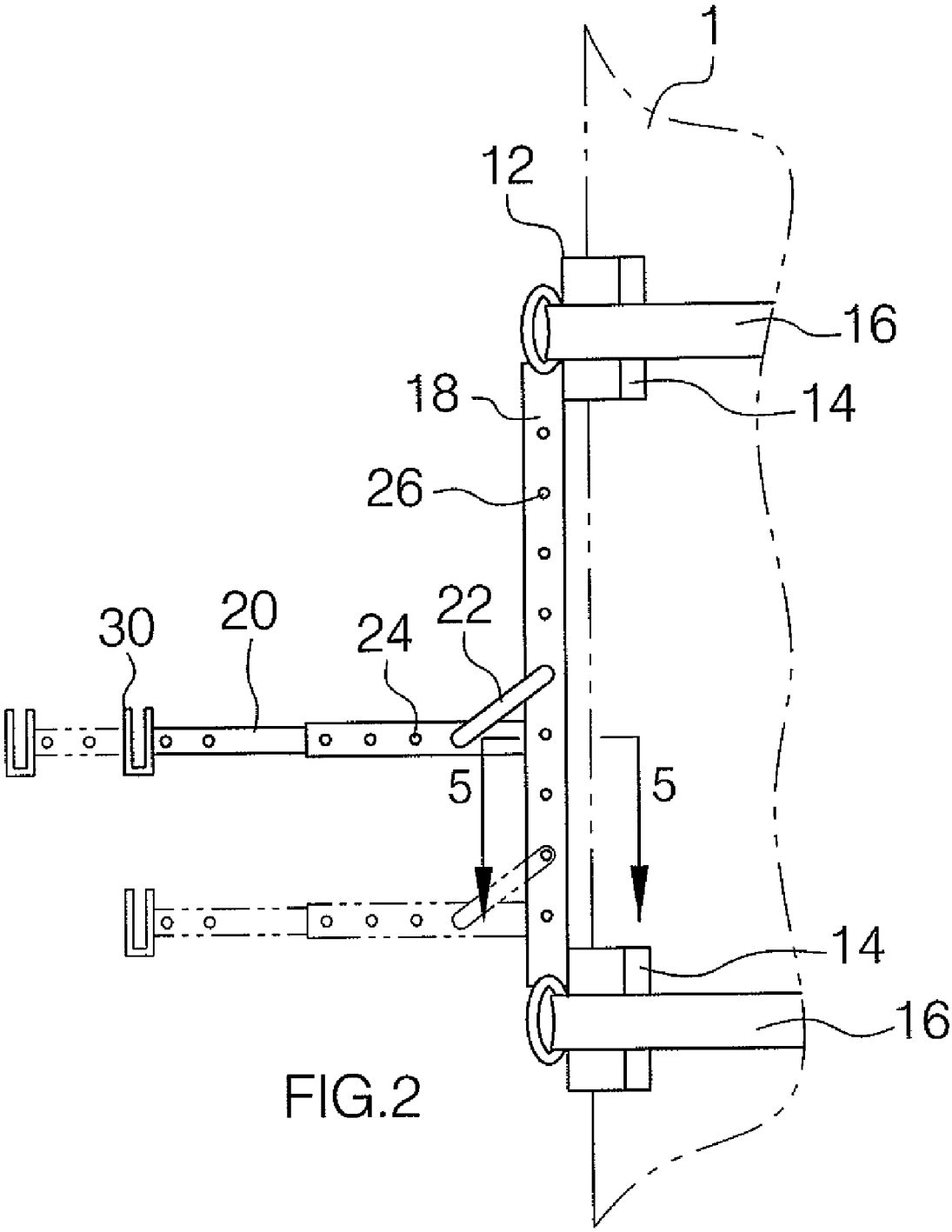
FIG. 2 is a front view of one of the mounting brackets of the present invention.
Figure 3:
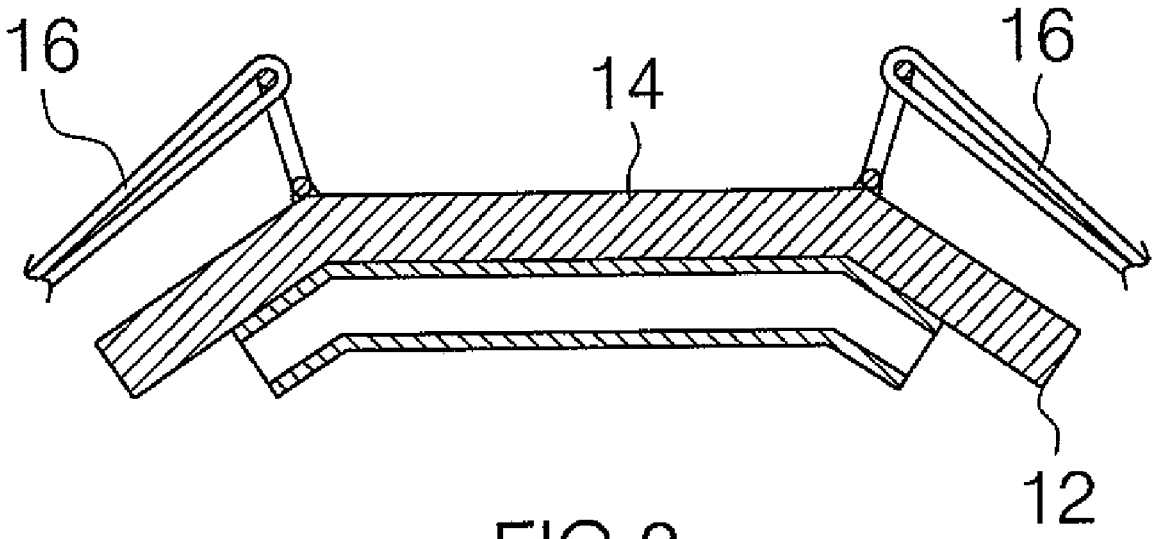
FIG. 3 is a cross-sectional view of the present invention taken along line 3-3 of FIG. 1.
Figure 4:
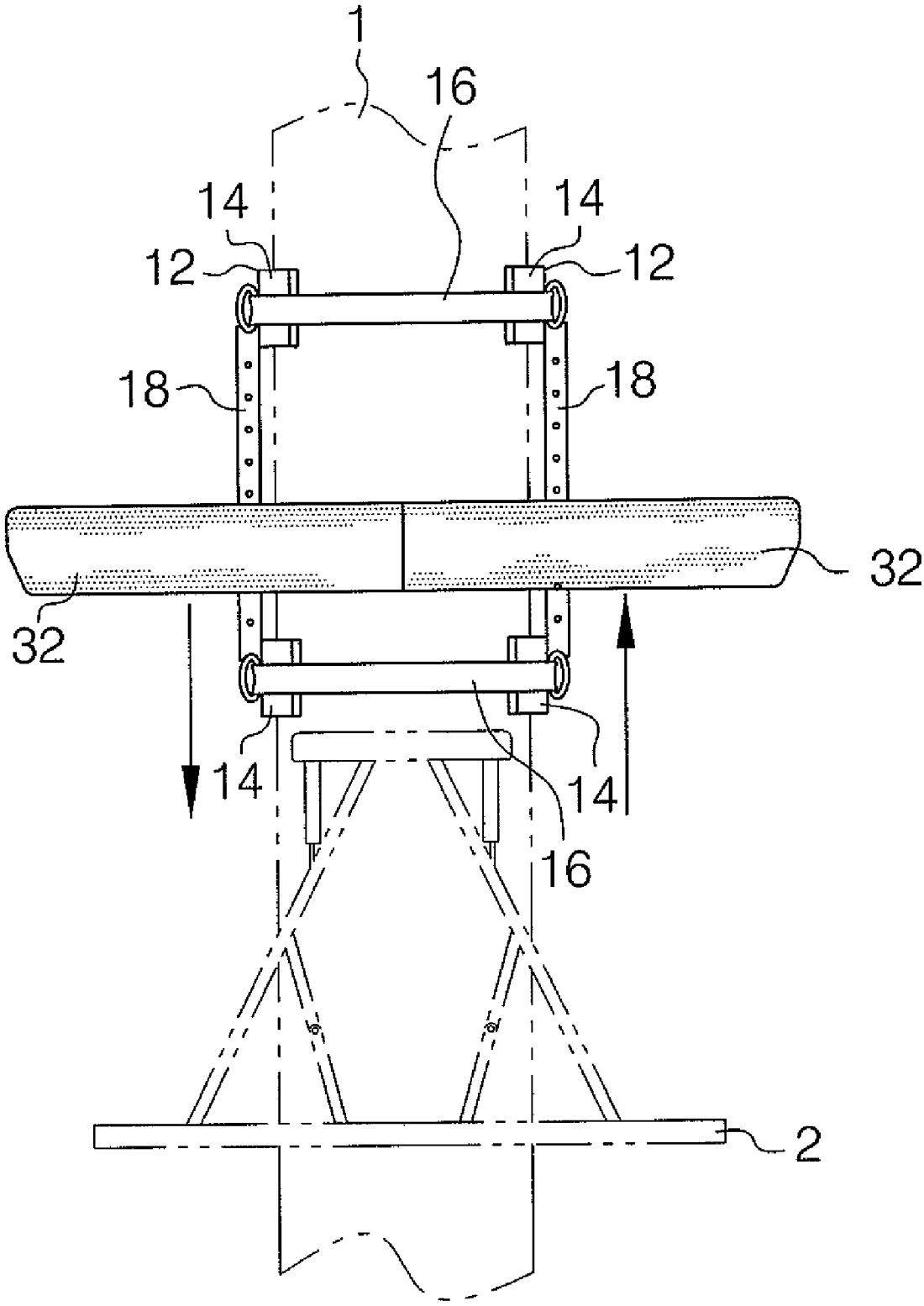
FIG. 4 is a front view of the present invention showing the blind curtains rolled around the suspension rod.
Figure 5:
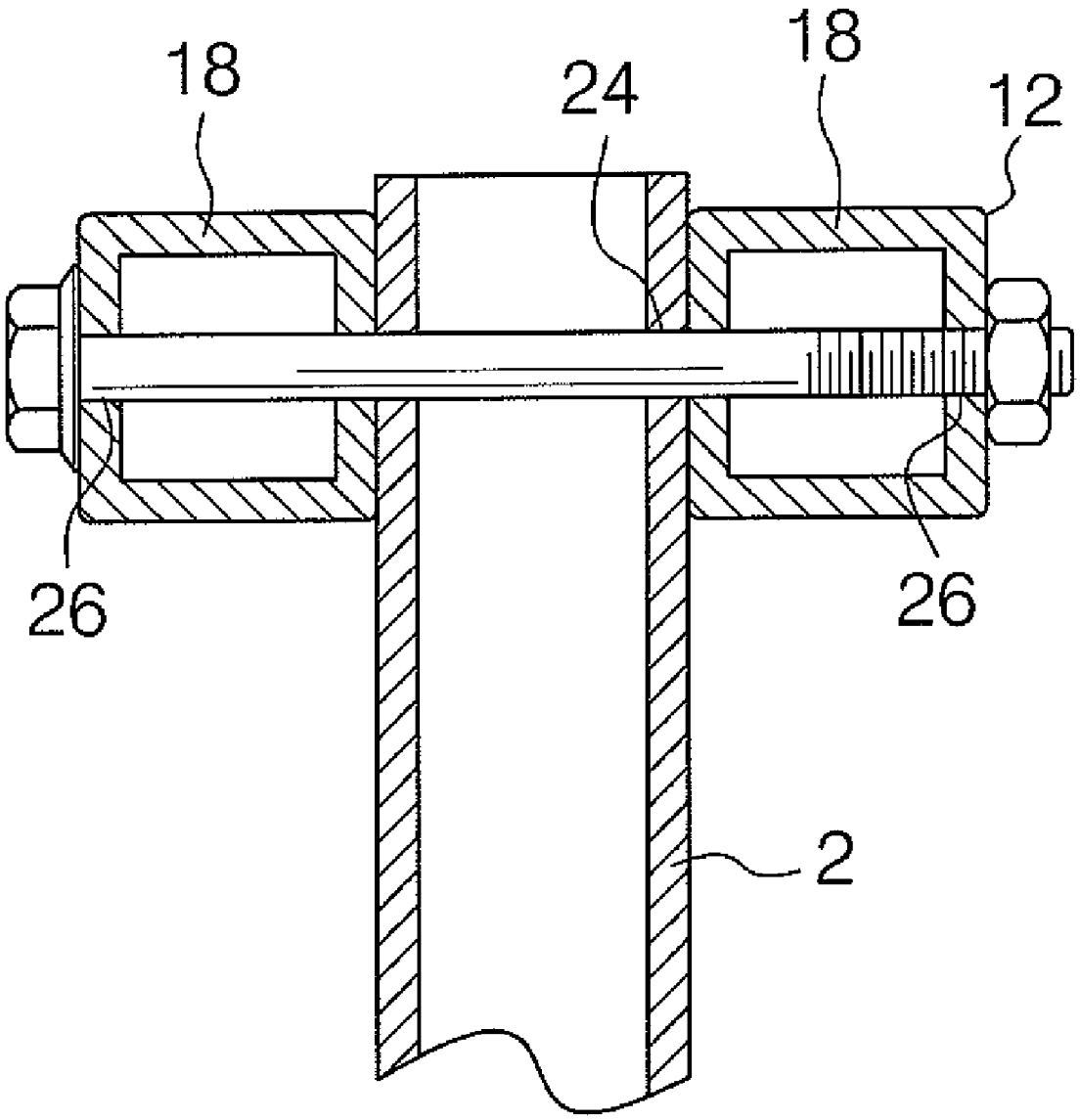
FIG. 5 is a cross-sectional view of the present invention taken along line 5-5 of FIG. 2.
Figure 6:
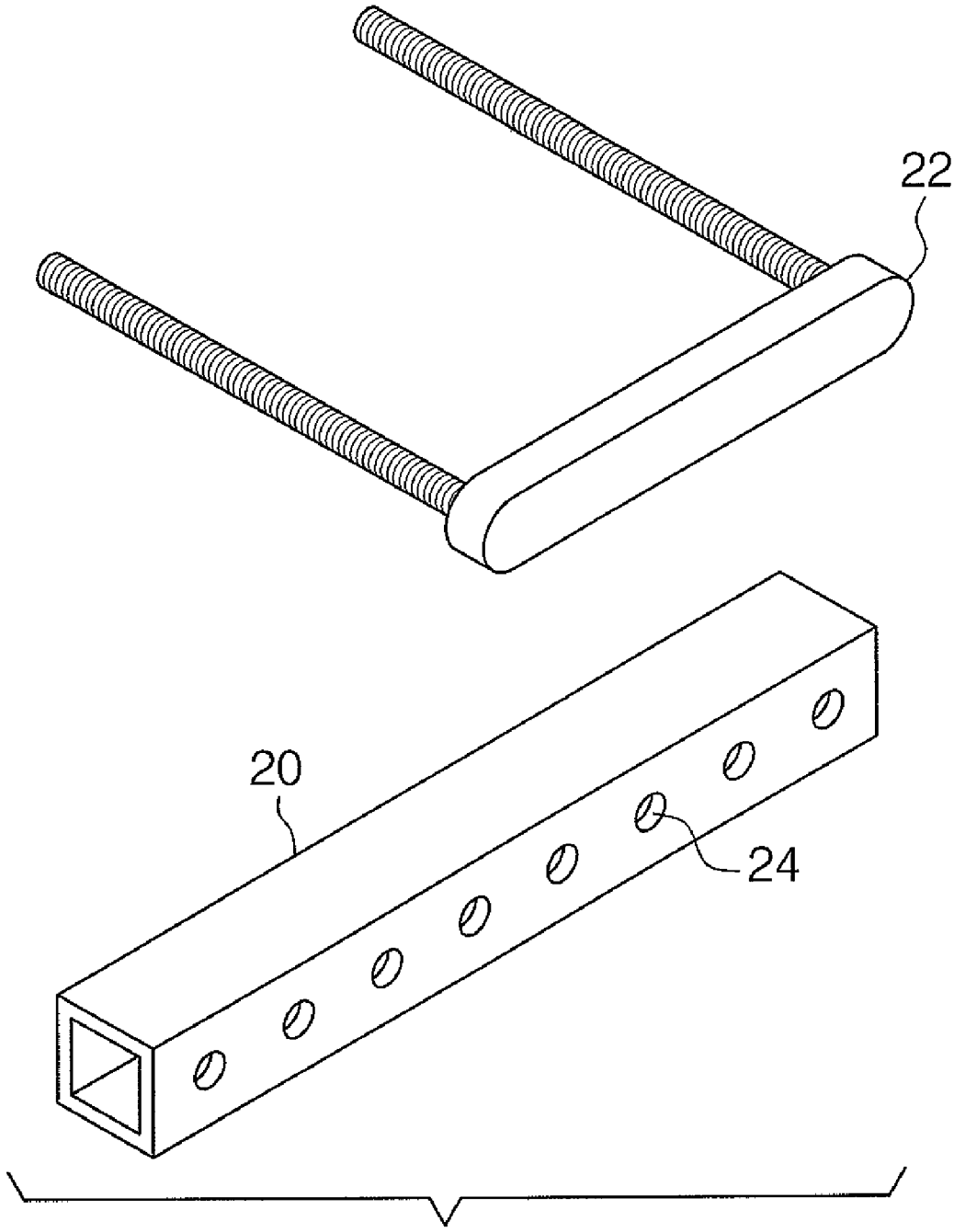
FIG. 6 is an exploded perspective view of a support mount and a portion of an arm of the present invention.
Figure 7:
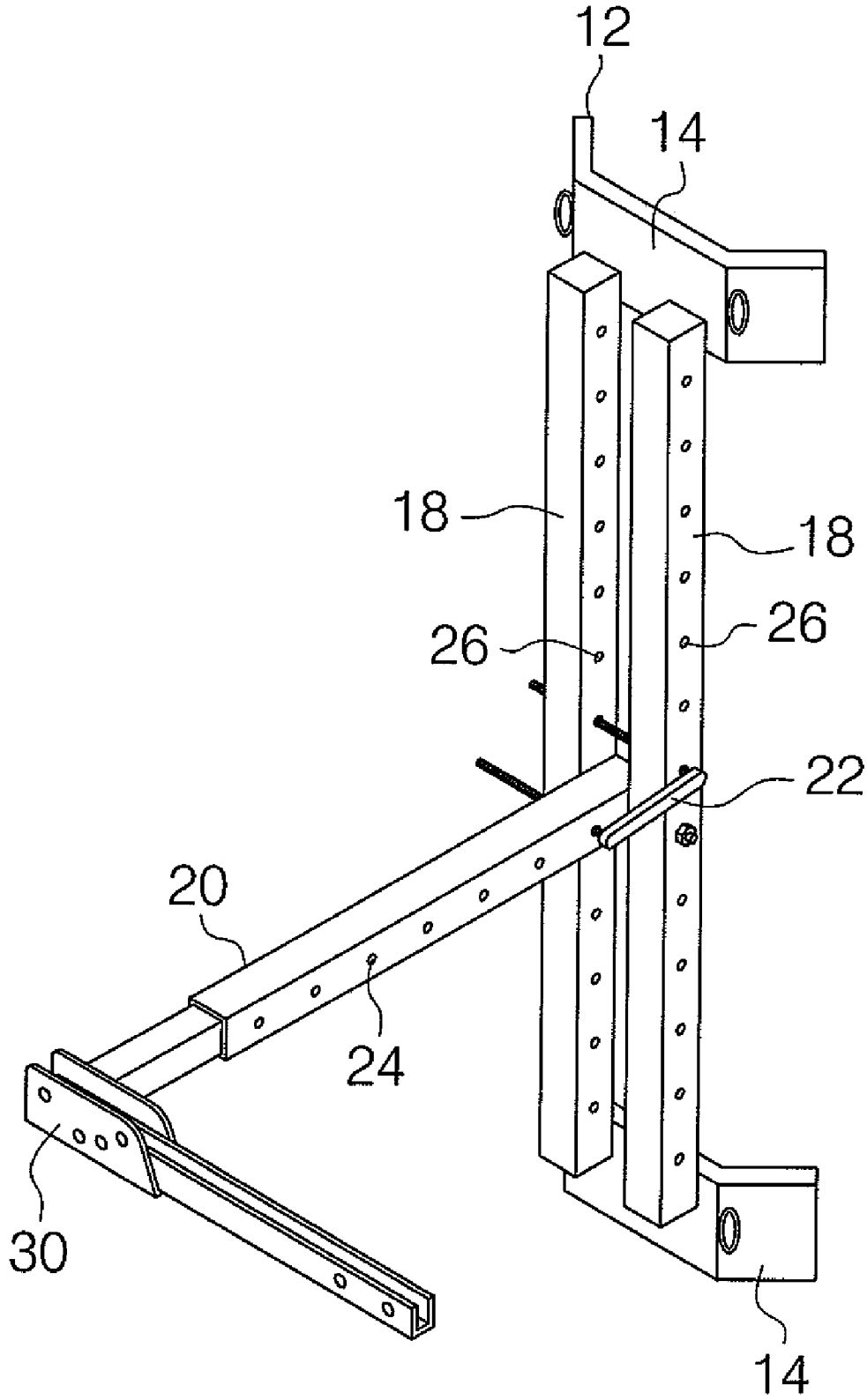
FIG. 7 is a perspective view of one the mounting brackets and one of the arms of the present invention.
Figure 8:
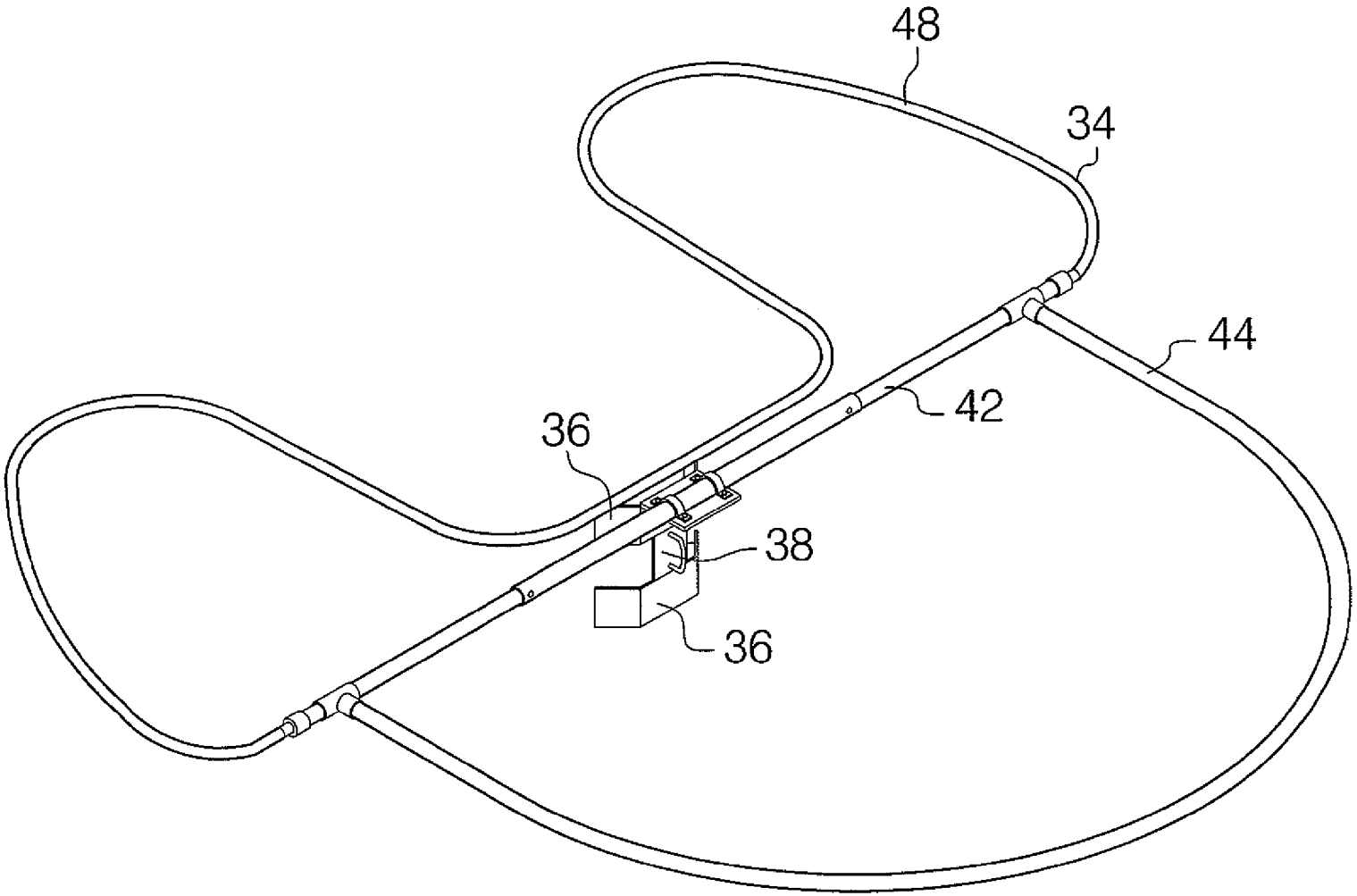
FIG. 8 is a perspective view of the canopy assembly of the present invention with the head cover and rear over removed.
Figure 9:
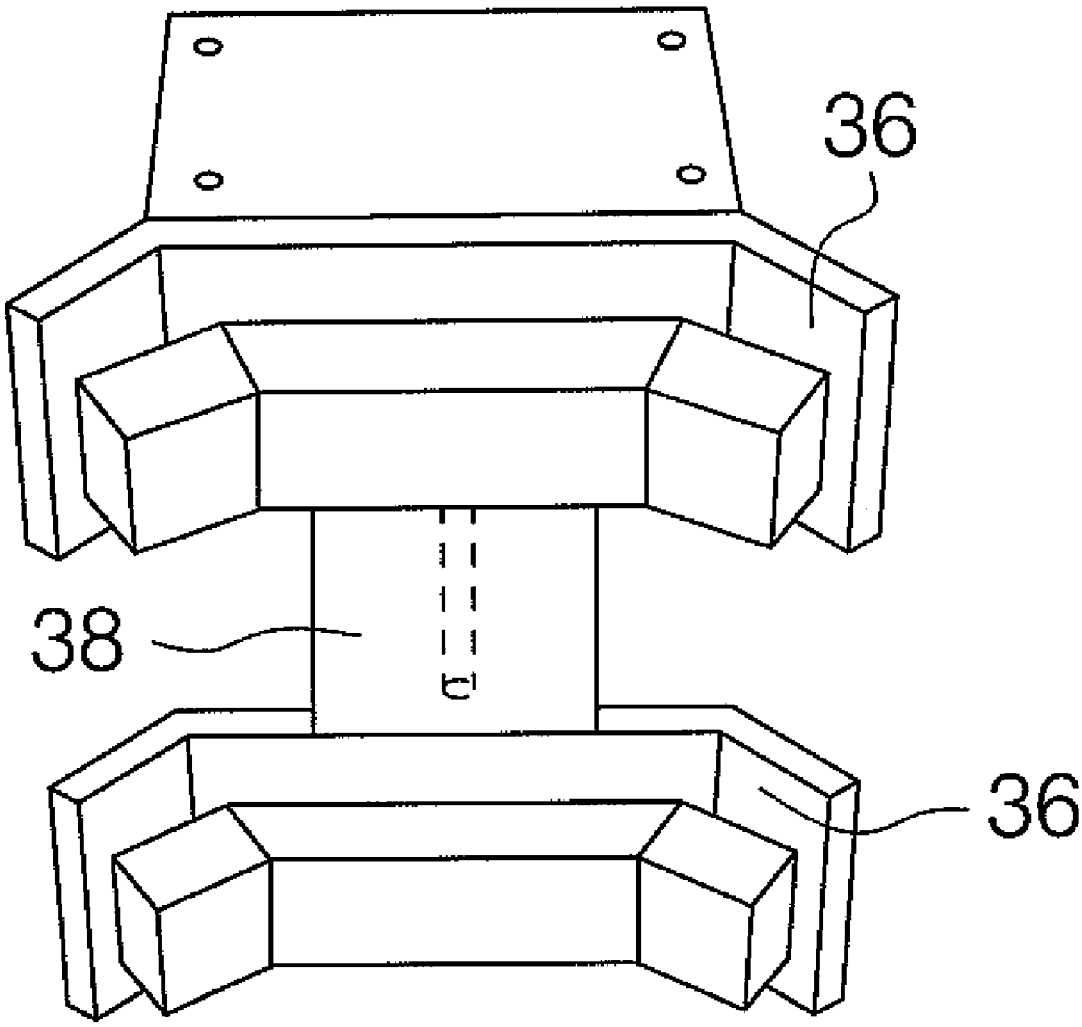
FIG. 9 is a perspective view of the canopy cradles of the present invention.
Figure 10:
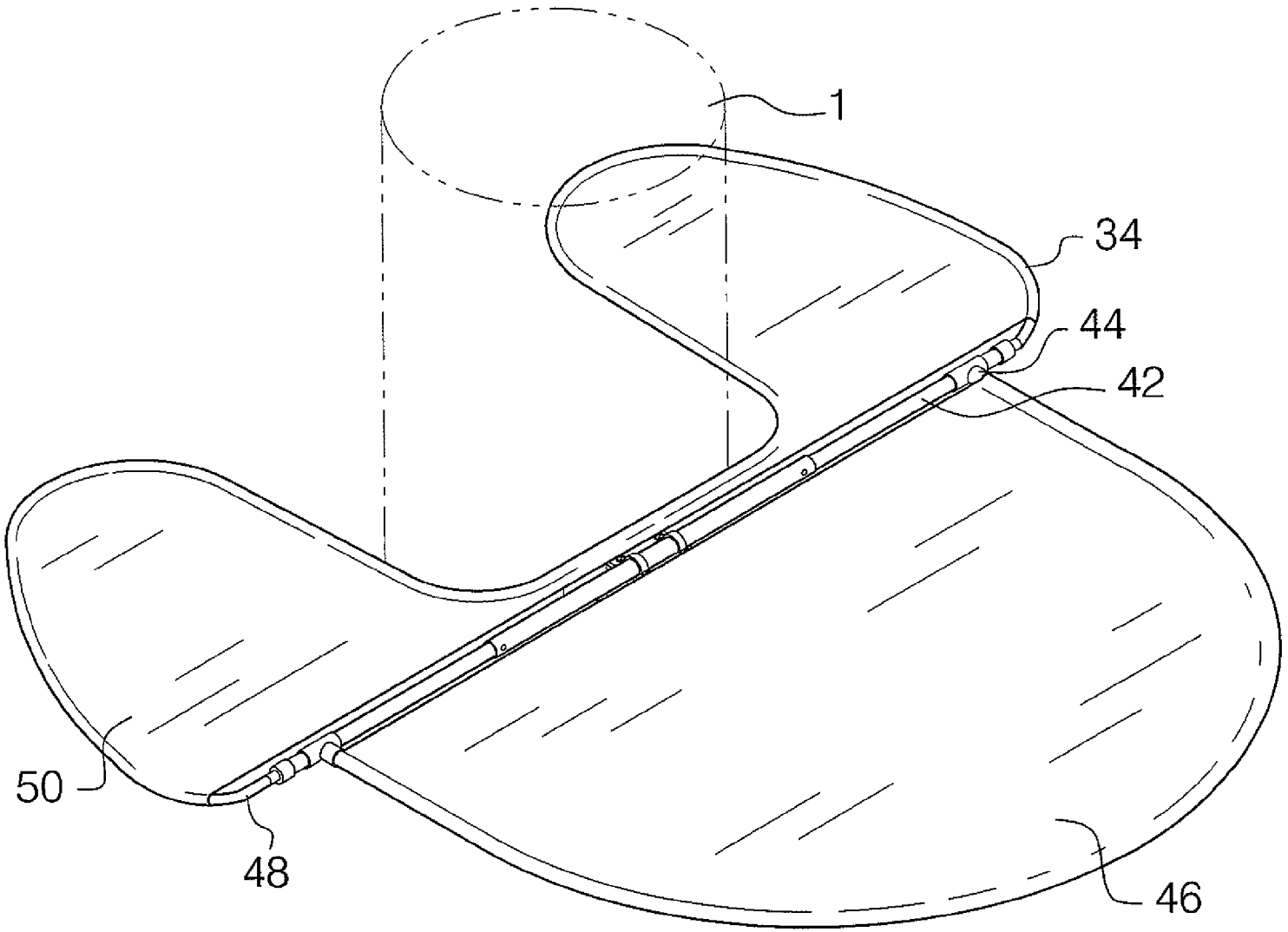
FIG. 10 is a perspective view of the canopy assembly of the present invention.

With reference now to the drawings, and in particular to FIGS. 1 through 10 thereof, a new hunting blind embodying the principles and concepts of the present invention and generally designated by the reference numeral 10 will be described.

As best illustrated in FIGS. 1 through 10, the tree stand blind system 10 generally comprises a pair of mounting brackets 12 is secured to a tree 1 adjacent a tree stand 2. Each of the mounting brackets 12 includes a pair of mounting cradles 14. The mounting cradles 14 extend around portion of a circumference of the tree 1. One of the mounting cradles 14 is vertically positioned above the other one of the mounting cradles 14 when the mounting cradles 14 are secured to the tree 1. Each of the mounting cradles 14 has one of a pair securing straps 16 mounted thereto. The securing straps 16 extend from the associated one of the mounting cradles 14 to a horizontally aligned one of the mounting cradles 14 of the other one of the mounting brackets 12. The securing straps 16 are actuated to compress the mounting cradles 14 against the tree 1 and secure the mounting brackets 12 to the tree 1. A pair of rails 18 is coupled to and extends between the mounting cradles 14.

Each of the mounting brackets 12 has one of a pair of arms 20 mounted thereto. A vertical orientation of each of the arms 20 is adjustable with respect to the associated one of the mounting brackets 12. The arms 20 are positioned horizontally and extend outwardly from the tree 1. The arms 20 are telescopic to permit selective adjustment of a length of each of the arms 20. Each of the arms 20 and the associated one of the mounting brackets 12 has one of a pair of support mounts 22 extending therethrough to maintain horizontal positioning of the arms 20. The support mounts 22 extend through an aperture 24 of the associated one of the arms 20 and a hole 26 of each of the rails 18 not aligned with the associated one of the arms 20 to support the arms 20 in the horizontal position. The support mounts 22 are approximately U-shaped.

A suspension rod 28 is insertable into a free end 30 of each of the arms 20. The suspension rod 28 is comprised of a resiliently flexible material to permit the suspension rod 28 to arcuately extend between the free ends 30 of the arms 20. A pair of blind curtains 32 is suspended from the suspension rod 28. The blind curtains 32 hang down from the suspension in a semi-circle around the tree stand 2 to conceal the hunter on the tree stand 2.

A canopy assembly 34 is mounted to the tree 1 above the mounting brackets 12. The canopy assembly 34 is positioned over the hunter on the tree stand 2 to inhibit rain from falling on the hunter. The canopy assembly 34 includes a pair of canopy cradles 36. The canopy cradles 36 extend around portion of the circumference of the tree 1. One of the canopy cradles 36 is vertically positioned above the other one of the canopy cradles 36. An alignment plate 38 is coupled to and extends between the canopy cradles 36 to maintain vertical alignment of the canopy cradles 36. A canopy strap 40 is secured to the alignment plate 38.

The canopy strap 40 is extended around the circumference of the tree 1. The canopy strap 40 is actuated to tighten the canopy strap 40 around the tree 1 and thereby compress the canopy cradles 36 against the tree 1.

The canopy assembly 34 also includes a canopy rod 42 coupled to one of the canopy cradles 36. The associated one of the canopy cradles 36 is centrally positioned on the canopy rod 42. The canopy rod 42 is positioned approximately horizontally and approximately tangential to the tree 1. A forward rod 44 is coupled to the canopy rod 42. The forward rod 44 extends in an approximately semi-circular configuration from the canopy rod 42. A head cover 46 is mounted to and extends across the forward rod 44. The head cover 46 is positioned over the head of the hunter to inhibit rain falling on the hunter from above the hunter.

The canopy cradle additionally includes a rear rod 48 coupled to the canopy rod 42 and extending away from the forward rod 44. The rear rod 48 is approximately U-shaped to allow the rear rod 48 to extend around a portion of the tree 1. A rear cover 50 is mounted to and extends across the rear rod 48. The rear cover 50 is positioned behind the hunter to inhibit rain falling on the hunter from behind the hunter.

In use, the mounting brackets 12 are secured to the tree 1 adjacent the tree stand 2. The length of the arms 20 mounted to the mounting brackets 12 is adjusted to the desired length. The suspension rod 28 is inserted into the arms 20 with the blind curtains 32 hanging therefrom to allow the blind curtains 32 to conceal the hunter. The canopy assembly 34 is then secured to the tree 1 above the hunter where the head cover 46 and the rear cover 50 inhibit rain from falling on the hunter on the tree stand 2.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tree stand blind system for concealing a hunter positioned on a tree stand, said system comprising:

a first mounting bracket and a second mounting bracket capable of being secured to a tree adjacent the tree stand, each of said first and second mounting brackets including;

a pair of mounting cradles, each of said mounting cradles extending around a portion of the tree, one of said mounting cradles being vertically positioned above the other one of said mounting cradles when said mounting cradles are secured to the tree;

a pair of rails being coupled to and extending between said mounting cradles; and a first arm being attached to said first mounting bracket and a second arm being attached to said second mounting bracket a vertical orientation of each of said first and second arms being adjustable with respect to the respective one of said first and second mounting brackets, each of said first and second arms being positioned horizontally and extending outwardly from the tree, each of said first and second arms being mounted to said rails of an associated one of said first and second mounting brackets;

a suspension rod being insertable into each of said first and second arms;

a first support mount extending through a first arm hole of said first arm and a first mounting hole of said first mounting bracket and a second support mount extending through a second arm hole of said second arm and a second mounting hole of said second mounting bracket to maintain horizontal positioning of said first and second arm, each of said first and second support mounts extending second mounting brackets through the respective said mounting hole located on one of said rails of the respective said mounting bracket so that each arm hole having the respective support mount extending therethrough is vertically positioned lower than the respective mounting hole having the respective support mount extending therethrough; and a pair of blind curtains being suspended from said suspension rod, said blind curtains hanging down from said suspension rod around the tree stand to conceal the hunter on the tree stand.

2. The system according to claim 1, wherein each of said first and second mounting brackets includes;

a pair of securing straps, a respective said securing strap extending from a respective said mounting cradle from said first mounting bracket to a horizontally aligned said mounting cradle on said second mounting bracket, said securing straps being actuatable to compress said mounting cradles against the tree and secure said mounting brackets to the tree.

3. The system according to claim 1, wherein each of said support mounts is approximately U-shaped.

4. The system according to claim 1, wherein each of said first and second arms is telescopic to permit selective adjustment of a length of each of said first and second arms.

5. The system according to claim 1, wherein said suspension rod is comprised of a resiliently flexible material to permit said suspension rod to extend between a free end of each of said first and second arms.

6. The system according to claim 1, further comprising a canopy assembly being mountable to the tree above said first and second mounting brackets, said canopy assembly being positionable over the hunter on the tree stand to inhibit rain from falling on the hunter.

7. The system according to claim 6, wherein said canopy assembly includes a pair of canopy cradles, each of said canopy cradles extending around a second portion of the tree, one of said canopy cradles being vertically positioned above a second of said canopy cradles.

8. The system according to claim 7, wherein said canopy assembly includes an alignment plate being coupled to and extending between said canopy cradles to maintain vertical alignment of said canopy cradles.

9. The system according to claim 8, wherein said canopy assembly includes a canopy strap being secured to said alignment plate, said canopy strap being extendable around a circumference of the tree, said canopy strap being actuated to tighten said canopy strap around the tree and thereby compress said canopy cradles against the tree.

10. The system according to claim 8, wherein said canopy assembly includes a canopy rod being coupled to said of said canopy cradles, the said canopy cradles being centrally positioned on said canopy rod, said canopy rod being positionable approximately horizontally and approximately tangential to the tree.

11. The system according to claim 10, wherein said canopy assembly includes a forward rod being coupled to said canopy rod, said forward rod extending in an approximately semi-circular configuration from said canopy rod.

12. The system according to claim 11, wherein said canopy assembly includes a head cover being mounted to and extending across said forward rod, said head cover being positionable over the head of the hunter to inhibit rain falling on the hunter from above the hunter.

13. The system according to claim 11, wherein said canopy assembly includes a rear rod being coupled to said canopy rod and extending away from said forward rod, said rear rod being approximately U-shaped to allow said rear rod to extend around a portion of the tree.

14. The system according to claim 13, wherein said canopy assembly includes a rear cover being mounted to and extending across said rear rod, said rear cover being positionable behind the hunter to inhibit rain falling on the hunter from behind the hunter.

15. A tree stand blind system for concealing a hunter positioned on a tree stand, said system comprising:

a first mounting bracket and a second mounting bracket being securable to a tree adjacent the tree stand, each of said first and second mounting brackets comprising;

a pair of mounting cradles, each of said mounting cradles extending around a portion of the tree, one of said mounting cradles being vertically positioned above the other one of said mounting cradles when said mounting cradles are secured to the tree;

a pair of rails being coupled to and extending between said mounting cradles;

a pair of securing straps, a respective said securing strap extending from a respective said mounting cradle from said first mounting bracket to a horizontally aligned said mounting cradle on said second mounting bracket, said securing straps being actuatable to compress said mounting cradles against the tree and secure said mounting brackets to the tree;

a first arm being attached to said first mounting bracket and a second arm being attached to said second mounting bracket, a vertical orientation of each of said first and second arms being adjustable with respect to the associated one of said first and second mounting brackets, each of said first and second arms being positioned horizontally and adapted to extend outwardly from the tree, each of said first and second arms being telescopic to permit selective adjustment of a length of each of said first and second arms;

a first support mount extending through said first arm and said first mounting bracket and a second support mount extending through said second arm and said second mounting bracket to maintain horizontal positioning of said first and second arms, each of said first and second support mounts extending through an aperture of the associated one of said first and second arms and a hole of an associated one of said rails, each of said first and second support mounts being approximately U-shaped;

a suspension rod being insertable into a free end of each of said first and second arms, said suspension rod being comprised of a resiliently flexible material to permit said suspension rod to extend between said free end of said first and second arms;

a pair of blind curtains being suspended from said suspension rod, said blind curtains hanging down from said suspension rod around the tree stand and adapted to conceal the hunter on the tree stand;

a canopy assembly being mounted to the tree above said mounting brackets, said canopy assembly being positionable over the hunter on the tree stand to inhibit rain from falling on the hunter, said canopy assembly comprising;

a pair of canopy cradles, each of said canopy cradles extending around a second portion of the tree, one of said canopy cradles being vertically positioned above a second of said canopy cradles;

an alignment plate being coupled to and extending between said canopy cradles to maintain vertical alignment of said canopy cradles;

a canopy strap being secured to said alignment plate, said canopy strap being extendable around a circumference of the tree, said canopy strap being actuatable to tighten said canopy strap around the tree and thereby compress said canopy cradles against the tree;

a canopy rod being coupled to and centrally positioned on one of said canopy cradles, said canopy rod being positioned approximately horizontally and approximately tangential to the tree;

a forward rod being coupled to said canopy rod, said forward rod extending in an approximately semi-circular configuration from said canopy rod;

a head cover being mounted to and extending across said forward rod, said head cover being positionable over the head of the hunter to inhibit rain falling on the hunter from above the hunter;

a rear rod being coupled to said canopy rod and extending away from said forward rod, said rear rod being approximately U-shaped to allow said rear rod to extend around a portion of the tree; and a rear cover being mounted to and extending across said rear rod, said rear cover being positionable behind the hunter to inhibit rain falling on the hunter from behind the hunter.

* * * * *